United States Patent [19]

Jonsson

[11] 3,973,607

[45] Aug. 10, 1976

[54] DEBARKING TOOL

[75] Inventor: Karl-Erik A. Jonsson, Gavle, Sweden

[73] Assignee: Brundell Och Jonsson AB, Gavle, Sweden

[22] Filed: Sept. 10, 1975

[21] Appl. No.: 611,875

[30] Foreign Application Priority Data

Sept. 25, 1974 Sweden ..... 7412070

[52] U.S. Cl. ..... 144/208 E; 144/241

[51] Int. Cl.[2] ..... B27L 1/00

[58] Field of Search ..... 144/208 E, 208 R, 240, 144/241

[56] References Cited

UNITED STATES PATENTS

| | | | |
|---|---|---|---|
| 2,911,020 | 11/1959 | Wennberg | 144/208 E |
| 3,282,310 | 11/1966 | Morenius et al. | 144/208 E |
| 3,709,272 | 1/1973 | Bowers | 144/208 E |

*Primary Examiner*—Donald R. Schran

*Attorney, Agent, or Firm*—Wenderoth, Lind & Ponack

[57] ABSTRACT

A debarking tool for debarking hollow rotors, comprising a shaft carrying a radially extending arm, said arm being pressed integrally from a steel plate to the shape of a chute adapted to face its concave side onto the feed direction of a log to be debarked.

3 Claims, 3 Drawing Figures

Fig. 1
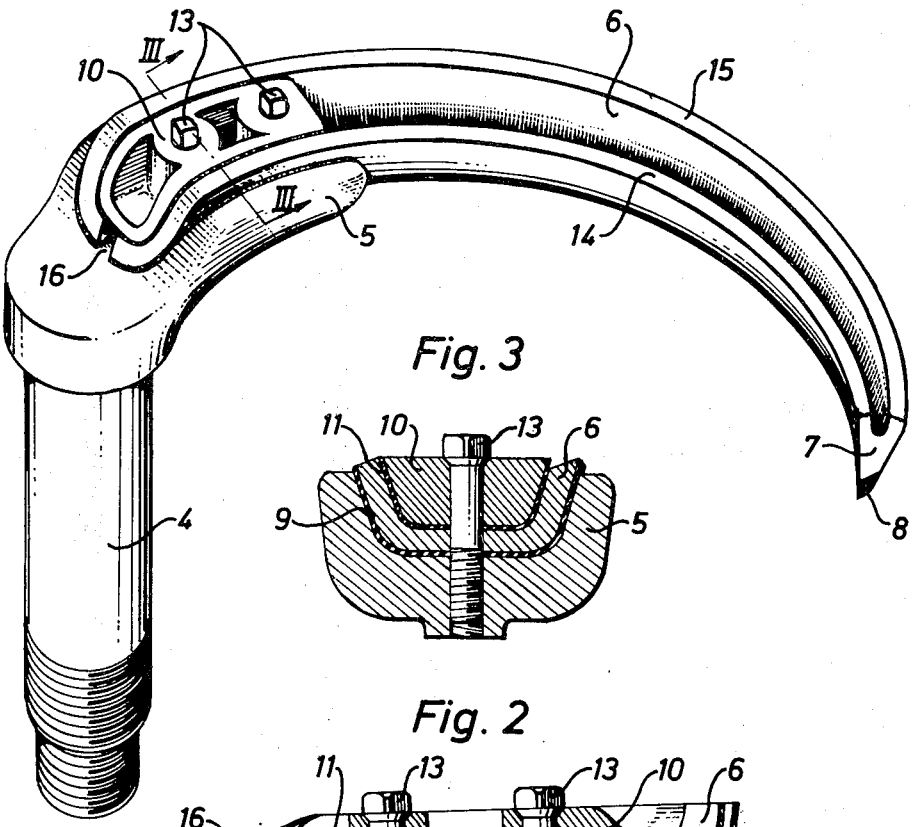
Fig. 3
Fig. 2
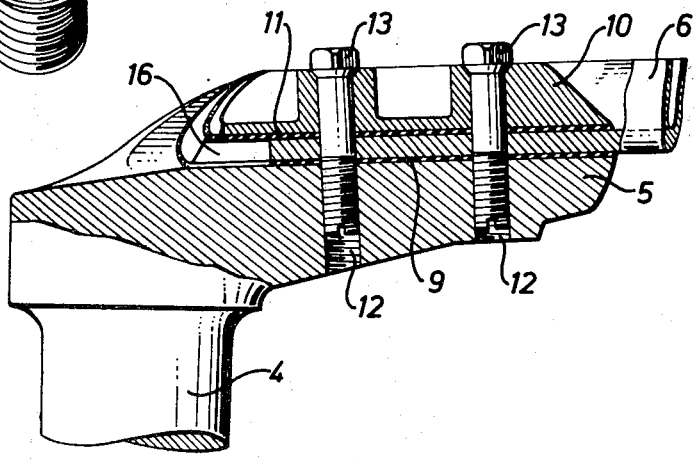

DEBARKING TOOL

BACKGROUND OF THE INVENTION

The invention relates to a debarking tool adapted for rotary debarking machines which may be of the type described in the U.S. Pat. Nos. 2,787,304 and 2,857,945, for instance. In the common way, the tool comprises a shaft adapted to be rotatably carried by a hollow rotor in parallel to the axis thereof, an arm extending substantially radially from said shaft and a debarking edge provided at the free end of the arm.

Generally, several debarking tools are mounted around the central opening of the rotor, and in their inoperative positions they extend about radially inwards with the cutting edges located close to the axis of the rotor. When the rotor rotates and a log is fed onto the rotor inlet, the fore end of the log hits the tool arms and forces them to rotate in opening direction against the action of resilient means. Hereby the cutting edges of the tools are caused to climb up on the log surfaces which has to be debarked.

SUMMARY OF THE INVENTION

The object of the invention is to provide a tool which is simple and cheap to manufacture, requires a minimum of material and has also further valuable qualities, as will be explained hereinafter. According to the invention, the arm of the tool is pressed integrally from a sheet of steel to the shape of a chute adapted to have its two borders and the concave side therebetween turned onto the feeding direction of a log supplied to be debarked in the rotor. Such a tool may be given a rather little weight, but yet it may be made sufficiently rigid to serve its purpose. Moreover, the new tool has the valuable effect that its two borders engage the fore end of a log supplied and transmit to the arm an effective torque in opening direction. The borders of the chute may be formed as more or less sharp or blunt edges, as desired.

Preferably, the shaft has a chute-shaped holder directed radially and adapted to receive the connection end of the chute-shaped arm. A pad of rubber may be inserted between the holder and the arm to take up shocks or abrupt impacts so that the arm and its shaft are, to a great extent, protected against ruptures. Also, the rubber insert has the advantage that the adjoining surfaces of the arm and of the holder need not be finished to a close fitting.

DETAILED DESCRIPTION OF A PREFERRED EMBODIMENT

The invention will be further described with reference to the accompanying drawing in which:

FIG. 1 shows a perspective view of a debarking tool according to the invention,

FIG. 2 shows a central portion of the tool, as seen from one side and partly in section, and FIG. 3 shows a cross section on the line III—III in FIG. 2.

The shaft 4 which is preferably made by casting, has in the usual way a threaded end portion adapted to be connected to an operating lever or similar means, not shown. The opposite end of of the shaft is made integrally with a chute-shaped holder 5 extending radially. As already mentioned, the arm 6 of the tool is made from a plate of steel, which is pressed to the form of a chute. In the embodiment shown, this chute is tapered onto its outer end, where a cutting bit 7 of high-alloy steel or hard metal is fixed by welding. Preferably, the edge 8 of the cutting bit 7 is as usual about parallel to the axis of the shaft 4. Also, in the common way, the chute-shaped arm 6 is preferably curved in a plane perpendicular to the axis of the shaft 4, and the chute-shaped holder 5 must then, of course, be curved correspondingly.

The connecting end of the arm 6 has its convex side fitted in the holder 5 by means of an inserted layer 9 of elastic rubber material, and a plate member 10 curved in conformity to the concave inside of the arm 6 is placed within the arm upon another layer 11 of elastic rubber. The three parts 5,6 and 10 are provided with aligned bores, and the bores 12 in the holder 5 are threaded to receive the threaded ends of connecting bolts 13.

As mentioned, the chute-shaped arm 6 has its concave side turned onto the feed direction of a log which is forwarded to be debarked in the rotor, and then the fore end of said log will be hit by the two longitudinal borders 14,15 of the chute 5. When the rotor rotates, these borders 14 and 15 serve to initiate the desired climbing of the tool up onto the log surface to be debarked. In the embodiment shown, the borders 14,15 are formed at the cutting of the steel plate before the pressing, but they may also be sharpened, if required.

Especially, the two climbing borders 14,15 of the tool have proved to be very useful for thick logs only a little smaller than the diameter of the rotor opening. In such case, the fore end of a log supplied will hit the arm of the tool at a rather short distance from the shaft 4, whereby a correspondingly greater force is required to initiate the rotation of the tool into its operative position. Such a greater torque is secured by means of the two borders 14,15 which engage the end surface of the log without the risk of fastening. Otherwise, it may sometimes happen that a tool having one climbing edge only penetrates deeply into the end of a log of soft wood and is jammed therein, if the log end is not broken.

The two rubber pads 9 and 11 between the adjoining surfaces of the connected members 5,6,10 permit the arm 6 to yield resiliently a little in any direction at heavy and abrupt shocks. For the same purpose, the rear end of the arm 6 may be provided with a longitudinal slit 16 which, however, must end at a safe distance from the adjacent hole 12.

As indicated in the preamble of the specification, the tool arms 6 are generally rotated in opening direction against the action of resilient means, i.e., the tools are resilient in the direction of rotation. On the other hand, the rubber pads provided according to the invention have, above all, for their purpose to prevent the tools from rupturing by relieving impacts directed axially, such as impacts caused by rapidly supplied heavy logs, for instance.

What I claim is:

1. A debarking tool for debarking machines of the hollow rotor type, comprising a shaft pivot adapted to be rotatably carried by the rotor in parallel to the axis of the latter, an arm extending substantially radially from the shaft, and a debarking edge provided at the free end of the arm, characterized in that the arm is pressed integrally from a sheet of steel to the shape of a chute having its two borders and concave side therebetween turned onto the feed direction of a log to be debarked in the rotor, whereby said borders engage the fore end of a log supplied to transmit to the arm a torque in opening direction.

2. A debarking tool as claimed in claim 1, in which the shaft is provided with a chute-shaped holder directed substantially radially and dimensioned to receive the convex side of the rear end portion of the chute-shaped arm, said two members being connected by screws after inserting a pad of elastic rubber material between their cooperating surfaces.

3. A debarking tool as claimed in claim 1, in which a cutting bit of hard metal is secured by welding to the outer end of the arm.

* * * * *